US005864728A

United States Patent [19]

Earle et al.

[11] Patent Number: 5,864,728

[45] Date of Patent: Jan. 26, 1999

[54] ADAPTER FOR USE WITH A PHOTOGRAPHIC PROCESSING APPARATUS

[75] Inventors: Anthony Earle, Harrow Weald, United Kingdom; John Howard Rosenburgh, Hilton, N.Y.

[73] Assignee: Eastman Kodak Company, Rochester, N.Y.

[21] Appl. No.: 628,215

[22] Filed: Apr. 4, 1996

Related U.S. Application Data

[60] Provisional application No. 60/003,489 Sep. 8, 1995.

[51] Int. Cl.[6] ..... G03D 3/08; G03D 13/08

[52] U.S. Cl. ..... 396/615; 396/638; 396/646

[58] Field of Search ..... 396/512, 638, 396/642, 647, 648, 615, 612, 646; 355/27–29

[56] References Cited

U.S. PATENT DOCUMENTS

| | | | |
|---|---|---|---|
| 4,406,534 | 9/1983 | Viehrig et al. | 396/612 |
| 4,719,483 | 1/1988 | Yamazaki | 396/594 |
| 4,742,216 | 5/1988 | Morse et al. | 396/595 |
| 4,843,430 | 6/1989 | Huber et al. | 396/599 |
| 5,373,338 | 12/1994 | Yamaguchi et al. | 396/612 |
| 5,434,643 | 7/1995 | Ishikawa et al. | 355/27 |
| 5,555,066 | 9/1996 | Benker | 396/613 |

FOREIGN PATENT DOCUMENTS

| | | |
|---|---|---|
| 502014 | 3/1939 | United Kingdom . |
| 867055 | 5/1961 | United Kingdom . |
| 1367443 | 9/1974 | United Kingdom . |
| 2041567 | 9/1980 | United Kingdom . |

*Primary Examiner*—D. Rutledge
*Attorney, Agent, or Firm*—Frank Pincelli

[57] ABSTRACT

Minilab paper processors are known for giving an exposure to photographic paper, processing the exposed paper and then drying the paper to produce photographic prints corresponding to negative filmstrips. Such processors have a second entry slot to the processing stage thereof through which a test strip can be introduced for processing. Described herein is an adapter for utilizing the second entry slot to supply paper for processing in the processor which has been exposed in apparatus other than that processor. The adapter comprises an elongate portion, which engages with the second entry slot of the processor section, a central slot, and a recess, lined with velvet plush material to ensure that the connection is light-tight, for receiving a cassette containing a roll of previously exposed photographic paper. One end of the cassette has an elongate protrusion having a slot formed therein and through which the paper can pass. The protrusion engages with the recess in adapter so that slot is aligned with slot to allow paper to pass from the cassette and into the processor section. A pair of guides are located beneath entry slot to guide the paper into drive rollers of the processor section.

10 Claims, 2 Drawing Sheets

ADAPTER FOR USE WITH A PHOTOGRAPHIC PROCESSING APPARATUS

CROSS REFERENCE TO RELATED APPLICATION

Reference is made to and priority claimed from U.S. Provisional Application Serial No. U.S. 60/003,489, filed 08 Sep. 1995, entitled AN ADAPTER FOR USE WITH A PHOTOGRAPHIC PROCESSING APPARATUS.

FIELD OF THE INVENTION

This invention relates to an adapter for use with a photographic processing apparatus. In further aspects the invention relates to a method of using a photographic processing apparatus and to a photographic processing apparatus combined with an adapter.

BACKGROUND OF THE INVENTION

One type of photographic processing apparatus is known as a "minilab". A typical minilab has three sections. The first section is a printer where negatives are exposed to photographic paper to record latent images on that paper. The exposed photographic paper is then fed into the second section, or processor. In the processor, the paper is treated with processing chemicals to develop the latent images so as to produce stable prints. The stable prints are then fed to the third section of the minilab, the dryer, where excess moisture is removed from the prints. As the exposed paper is being developed in the processor, the processing chemicals are consumed and have to be replenished. Tests are made periodically to check that the correct quantity and concentration of processing chemicals is present in the processor and to ensure that the chemical sections of the minilab are in balance. The tests involve feeding carefully exposed test strips into the processor section through a dedicated slot known as a test strip feed slot. Test strips are commonly about 0.3 m long and can have a series of colored strips exposed onto them. They are held flat in special holder which is attached to the test strip feed slot to ensure that the test strip is not affected by light, prior to it being fed into the processor section. Examination of the test strip after it has been developed in the processor will give an indication of whether the chemical balance in the processor is correct and whether the sections of the minilab are correctly balanced.

Problem to be Solved by the Invention

One of the major advantages of a minilab of the type described above, is its simplicity of use. Essentially, provided that the machine is set up correctly and operating correctly, all an operator needs to do is feed photographic negatives into the printer and remove finished prints from the dryer. The operator does not need to handle anything other than the negatives and the finished prints. The processing of the negatives into prints can be highly automated allowing relatively unskilled operators to work the machine. This advantage, however, is in some respects a disadvantage. A minilab lacks flexibility. Since it is dedicated to producing prints from photographic negatives and cannot be used to produce prints from other sources such as a photo-CD or an electronic camera.

U.S. Pat. No. 4,218,123 discloses a machine for developing exposed photographic paper which is capable of accepting webs of exposed photographic paper of varying sizes from a number of sources. The machine includes a light-tight housing which is capable of receiving different sizes of cassettes housing webs of exposed paper, a dedicated feed table, and drive rollers for feeding exposed web from the cassette contained within the housing into the processor via the feed table. The machine described in U.S. Pat. No. 4,218,123 has a number of disadvantages. First it is not a minilab as such since it only has the capability to develop paper which has already been exposed by a separate printer. It thus lacks one of the major advantages of a minilab—the simplicity of operation of the same. The adapter shown in U.S. Pat. No. 4,218,123 is unsuitable for use with a minilab and, even if it were fitted to an existing minilab, extensive alterations would have to be made to that minilab. Further, the adapter shown in U.S. Pat. No. 4,218,123 is complicated, has a large number of parts, and, consequently would be expensive.

SUMMARY OF THE INVENTION

In a first aspect, the present invention provides an adapter for use with a photographic processing apparatus having a processor for developing photographic material and first and second entry points for feeding photographic material into that processor, the adapter comprising:

a first end which is configured to mate with a cassette in a light-tight manner;

a second end which is configured to mate in a light-tight manner with the second entry point of the processor; and a passage for allowing photographic material to pass through the adapter between the first and second ends, the arrangement being such that a web of exposed photographic paper stored in the cassette may be fed from the cassette into the processor via the second entry point.

Conveniently, the second end of the adapter is adapted to mate with the test strip feed slot of the processor.

In a preferred embodiment, the first end of the adapter defines an elongate slot which is adapted to mate with a corresponding protrusion on a cassette, the slot being lined with a material which renders the mating connection between the adapter and the cassette light-tight, and wherein the second end defines an elongate protrusion which is adapted to mate with a test strip entry point on a photographic processing apparatus in a light-tight manner.

The adapter may be made of an opaque plastics material, such as PVC. The lining may be velvet plush.

In a second aspect, the invention provides a method of using a photographic processing apparatus having a processor for developing photographic material and having first and second entry points into the processor, the method comprising the steps of:

exposing a web of photographic material to record a latent image, or series of latent images on that material and storing the same in a cassette;

connecting the cassette to the second entry point of the processor via an adapter; and feeding the web of exposed photographic material from the cassette through the adapter and into the processor to develop the latent image or images recorded on the material.

Conveniently, the second entry point is a test strip feed slot of a minilab.

In a preferred embodiment, the web of exposed photographic material stored in the cassette is a roll of photographic paper.

In a third aspect, the present invention provides a photographic processing apparatus comprising:

a printer for exposing photographic negatives to photographic paper;

a processor for developing the exposed photographic paper;

a first entry point into the developer for transfer of exposed photographic paper from the printer to the processor; and a second entry point into the processor characterized by:

an adapter having a first end which is arranged to mate with a cassette in a light-tight manner; and a second end which is mated in a light-tight manner with the second entry point of the processing apparatus, the arrangement being such that a web of exposed photographic paper stored in the cassette may be fed into the processor for developing via the adapter and the second entry point of the processor.

Conveniently the second entry point is a test strip feed slot.

Typically, the photographic paper is stored as a roll in the cassette.

Advantageous Effect of the Invention

The advantage of the present invention is that it allows an existing minilab to accept paper from other printing devices without having to make any modifications to the minilab. The adapter allows a roll or web of exposed photographic paper to be fed from a cassette directly onto the processor of a minilab via a second entry point of the processor, which may conveniently be the test strip feed slot of the processor. The paper stored in the cassette may have been exposed to images from various sources such as photo-CDs or electronic cameras. Because the adapter utilizes the second entry point, no adjustments have to be made to the printer of the minilab. The adapter is inexpensive and simple to use and does not affect the normal working of the minilab. Once paper from a different printing device has been developed in a minilab, that minilab may then immediately be used to continue producing prints from negatives. The adapter may be fitted to any minilab or photographic processing apparatus with a second entry point.

BRIEF DESCRIPTION OF THE DRAWINGS

For a better understanding of the present invention, reference will now be made, by way of example only, to the accompanying drawings in which.

DETAILED DESCRIPTION OF THE INVENTION

Figure 1:
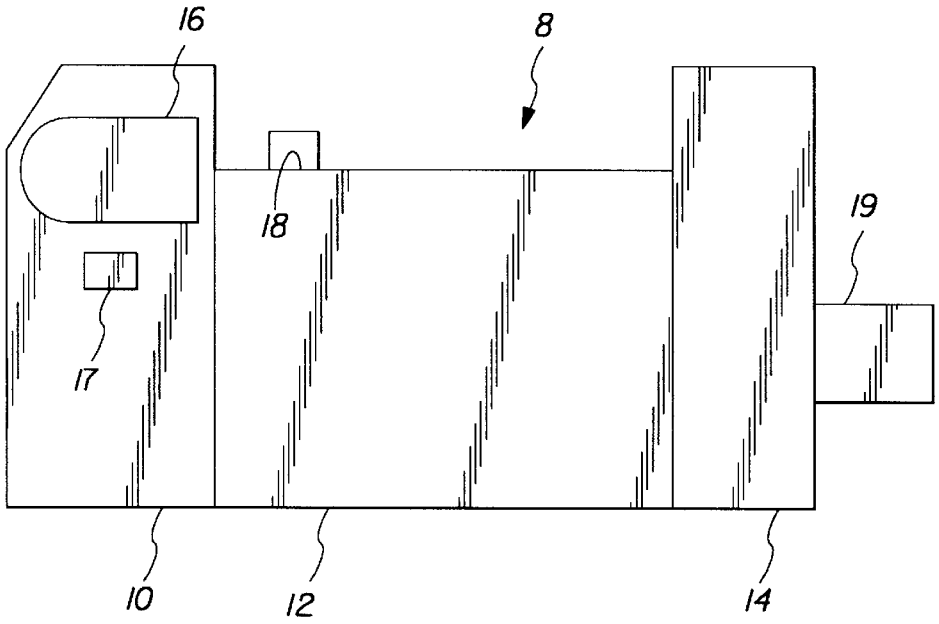
FIG. 1 is a schematic illustration of a minilab.

Referring to the drawings, FIG. 1 shows a typical minilab 8 having three sections, a printer 10, a processor 12, and a dryer 14. The printer 10 houses a cassette 16 which contains a roll or web of unexposed photographic paper (not shown). Photographic negatives which are used to record latent images on the photographic paper are fed into the printer at print gate 17. After the photographic paper has been exposed to the negatives, it is fed into the processor 12 where the latent images recorded on the photographic paper are developed. The processed prints are fed into the third stage of the minilab, the dryer 14, where excess moisture is removed from the prints. Finished prints 19 are then fed out of the dryer 14. The processor 12 includes a test strip feed slot 18 which allows test strips to be fed into the processor to test whether the correct balance of processing chemicals is present in the processor.

Figure 2:
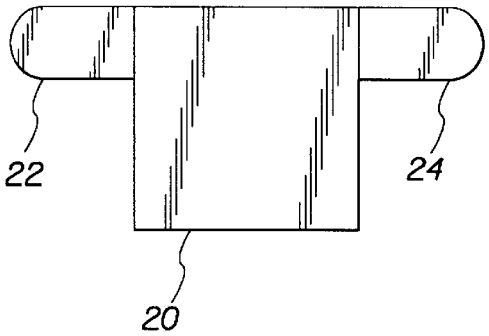
FIG. 2 is a schematic illustration of a printing device including a cassette containing exposed photographic paper.

FIG. 2 shows an alternate printing device for exposing an exposed photographic paper. The printing device 20 feeds unexposed paper from a cassette 22, exposes the paper to record a latent image on it and then stores the exposed paper in a second cassette 24. The cassettes 22 and 24 are identical in design and can be the same as that used in the minilab. Printing device 20 may comprise any desired type of device used to record images from any suitable source onto photographic paper in cassette 22. For example, scanned images, digital images, optical images, photo-CD images and images from electronic cameras may all be transferred to the photographic paper by device 20.

Figure 3:
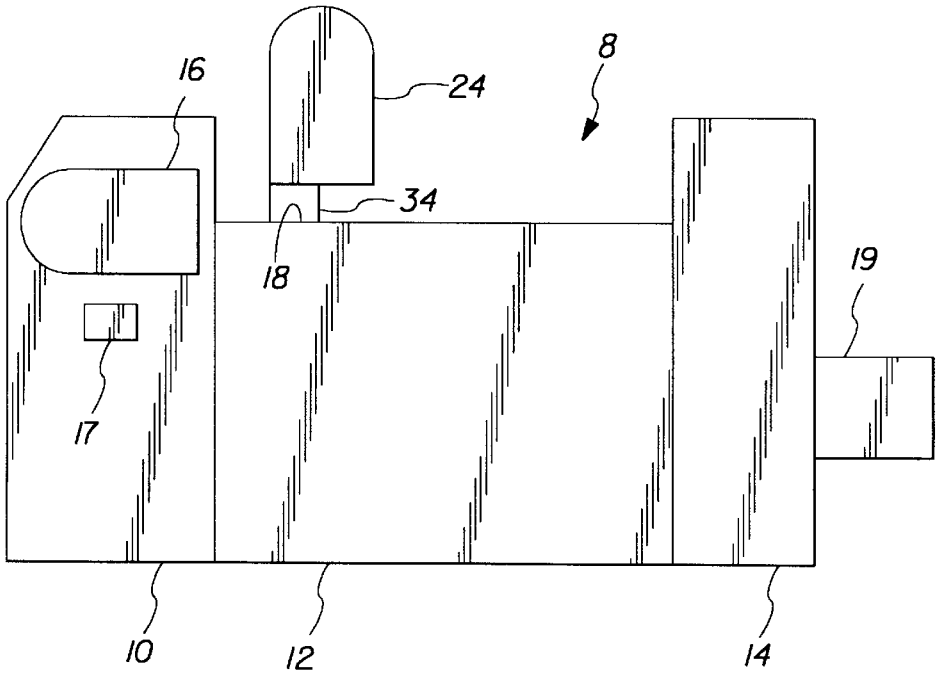
FIG. 3 is a schematic illustration of the cassette from the exposing station of FIG. 2 being fed into a minilab utilizing an adapter made in accordance with the present invention.

Once an image has been recorded onto photographic paper and stored in cassette 24, the cassette 24 is removed from the device 20 and transferred to the test strip feed slot 18 of the minilab through the adapter 34, as shown in FIG. 3.

Figure 4:
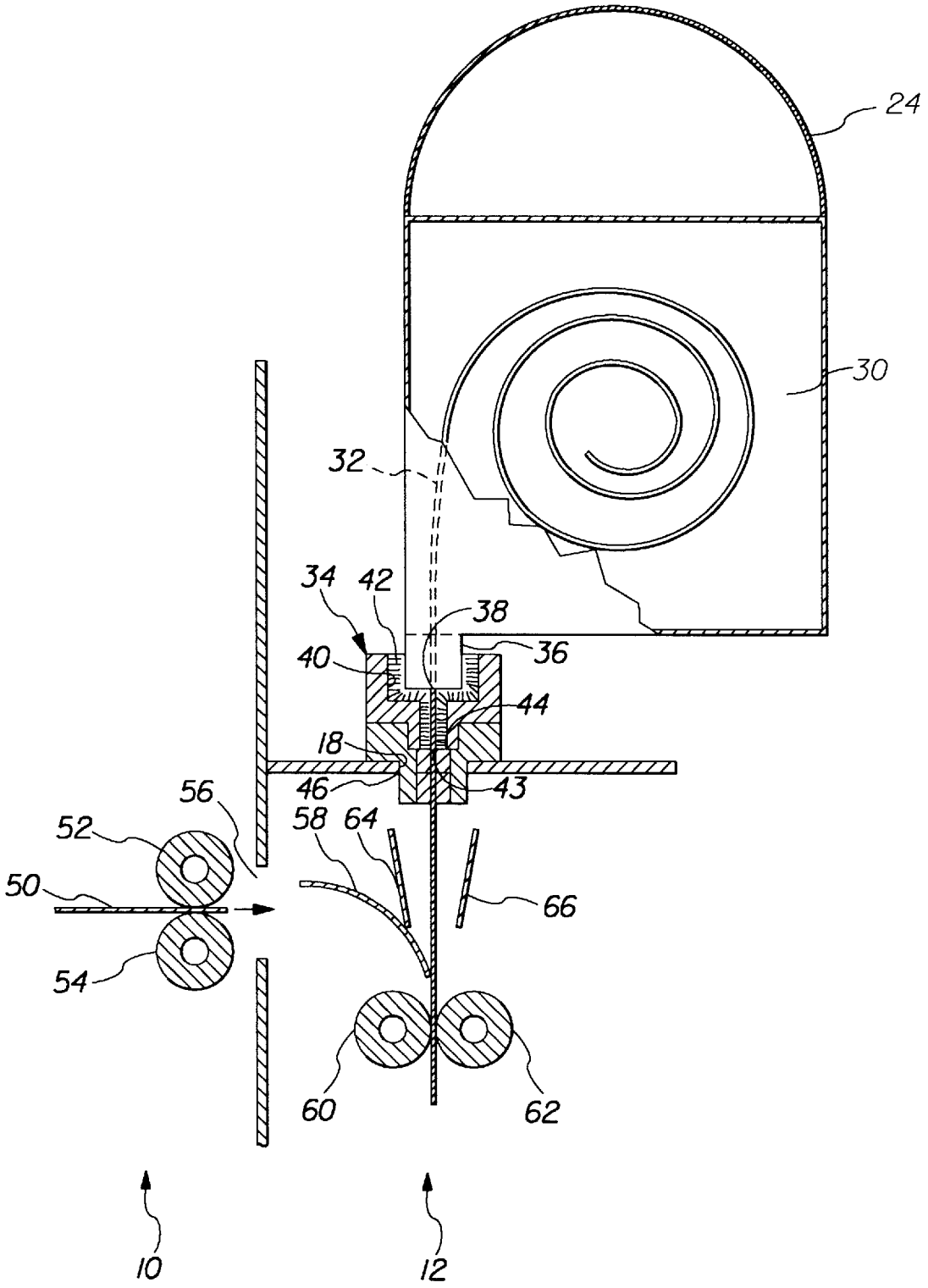
FIG. 4 is a partial cross-section through the cassette, adapter, and minilab of FIG. 3.

FIG. 4 shows the arrangement in more detail. The cassette 24 contains a roll, or web 30, of exposed photographic paper. Dotted line 32 shows paper passing from the cassette 24 into the processor 12 of the minilab via the adapter 34. In the preferred embodiment illustrated, adapter 34 is of a single piece of construction, generally of an appropriate plastic material so that it can be easily and economically produced. One end of the cassette 24 defines an elongate protrusion 36 which has a slot 38 through which paper can pass. That protrusion 36 mates with a corresponding recess 40 in one end of the adapter 34. The recess 40 is lined with velvet plush material 42 to ensure that the connection between adapter 34 and cassette 24 is light-tight. The center of the adapter defines a slot 43 which allows paper to pass through the adapter 34. The other end of the adapter 34 defines an elongate protrusion 44 which is arranged to mate with the test strip feed slot 18 in a light-tight manner. The test strip feed slot 18 is light-tight at 46.

FIG. 4 also shows other features of the printer and processor sections 10,12 of the minilab 8 itself. Paper 50 which has been exposed to negatives in printer 10 is fed via drive rollers 52, 54 into the processor 12 via the first entry point 56 to the processor 12 as is typically done in the prior art. A guide 58 then guides the paper to the first pair of drive rollers 60, 62 of the processor 12 where it is processed in the typical manner. A pair of further guides 64, 66 are positioned beneath the test strip entry slot 18. Guides 64, 66 are typically used to guide test strips to the drive rollers 60, 62 in minilab 8. In the present invention guides 64, 66 also serve to guide exposed paper from cassette 24 to those same rollers 60, 62. The paper then passes into processor 12 in the same manner as paper from printer 10. None of these features require any adjustment to allow paper to be fed into the processor via the test strip feed slot.

As can be seen, the present invention allows existing minilabs to be used to process exposed photographic paper from a variety of sources without the need to make any alterations to the minilab and without affecting the normal operation of the minilab. All that is required to convert an existing minilab to receive exposed photographic material from other sources is an adapter of the type described above.

Parts list

8 . . . minilab
10 . . . printer

12 . . . processor
14 . . . dryer
16 . . . cassette
17 . . . print gate
18 . . . slot
19 . . . prints
20 . . . printing device
22,24 . . . cassettes
30 . . . web
34 . . . adapter
36 . . . protrusion
38 . . . slot
40 . . . recess
42 . . . velvet plush material
43 . . . slot
44 . . . elongate protrusion
50 . . . paper
52,54 . . . drive rollers
56 . . . first entry point
58 . . . guide
60,62 . . . drive rollers
64,66 . . . guides

We claim:

1. An adapter in combination with a photographic processing apparatus, comprising a processor for developing photographic material and an entry point for feeding a photographic material into said processor of a first format, the adapter comprising:

a first end which is configured to mate with a cassette in a light-tight manner, said cassette containing a photosensitive material of a second format different from said first format;

a second end which is configured to mate in a light-tight manner with the second entry point of the processor; and a passage for allowing photosensitive material to pass through the adapter between the first and second ends;

said adapter permitting a web of exposed photosensitive material of the second format stored in the cassette to be fed from the cassette into the processor via the second entry point for developing of the photosensitive material of the second format.

2. An adapter according to claim 1, wherein the second end is configured to mate with a test strip feed slot of the processor.

3. An adapter according to claim 1, wherein the first end of the adapter defines an elongate slot which is adapted to mate with a corresponding protrusion on the cassette, the slot being lined with a material which renders the mating connection between the adapter and the cassette light-tight, and wherein the second end defines an elongate protrusion which is adapted to mate with the second entry point on the photographic processing apparatus in a light-tight manner.

4. An adapter according to claim 1, wherein the adapter is made of a plastics material and the first end is lined with velvet plush material.

5. A method of using a photographic processing apparatus having a processor for developing photographic material and having first and second entry points into the processor, said first and second entry points feeding said photographic material to a single processing path, said first entry point being designed to receive a photosensitive material of a first format for processing the photographic material of the first format, the method comprising the steps of:

exposing a web of photographic material to record a latent image, or series of latent images, on that material and storing the same in a cassette, said cassette containing a photosensitive material of a second format different from said first format;

connecting the cassette to the second entry point of the developing section via an adapter; and feeding the web of exposed material from the cassette through the adapter and into the processor to develop the latent image or series of latent images.

6. A method according to claim 5, wherein the second entry point is a feed slot of a minilab which is adaptable for insertion of a test strip.

7. A method according to claim 5, wherein the web of photographic material stored in the cassette is a roll of photographic paper.

8. A photographic processing apparatus comprising:

a printer for exposing photographic negatives to photographic paper of a first format;

a processor for developing the exposed photographic paper;

a first entry point into the processor for transfer of the exposed photographic paper from the printer to a processing path of the processor;

a second entry point into the processor to receive a photosensitive material of a second format different from the first format and leading the photosensitive material to the processing path; and an adapter having a first end which is arranged to mate with a cassette in a light-tight manner;

wherein the adapter has a second end which is connectable in a light-tight manner with the second entry point on the processor, said cassette containing the photosensitive material of the second format;

the arrangement being such that the photosensitive material of the second format in the cassette may be fed directly into the processor via the adapter and the second entry point of the processor.

9. A photographic processing apparatus according to claim 8, characterized in that the second entry point is a feed slot which is adaptable for insertion of a test strip.

10. A photographic processing apparatus according to claim 8, wherein the cassette is adapted to store a web of photographic paper as a continuous roll.

* * * * *